US008720645B2

(12) United States Patent
Parker

(10) Patent No.: US 8,720,645 B2
(45) Date of Patent: May 13, 2014

(54) STEP STOOL AND METHOD

(71) Applicant: Thomas W. Parker, Jamestown, PA (US)

(72) Inventor: Thomas W. Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 13/941,137

(22) Filed: Jul. 12, 2013

(65) Prior Publication Data

US 2013/0292206 A1 Nov. 7, 2013

Related U.S. Application Data

(62) Division of application No. 13/134,514, filed on Jun. 9, 2011, now Pat. No. 8,490,748, which is a division of application No. 11/698,412, filed on Jan. 26, 2007, now Pat. No. 7,963,369.

(51) Int. Cl.
*E06C 1/00* (2006.01)

(52) U.S. Cl.
USPC ..... 182/165; 182/180.1; 182/161

(58) Field of Classification Search
USPC ..... 182/165, 180.1, 161
See application file for complete search history.

(56) References Cited

U.S. PATENT DOCUMENTS 2,834,526 A * 5/1958 Paris ..... 182/16
6,550,579 B2 * 4/2003 Gibson et al. ..... 182/161
8,146,710 B2 * 4/2012 Moldthan et al. ..... 182/165

* cited by examiner

*Primary Examiner* — Alvin Chin Shue
(74) *Attorney, Agent, or Firm* — Ansel M. Schwartz

(57) ABSTRACT

A folding step stool includes a front rail assembly. The step stool includes a rear rail assembly, pivotally connected to the front rail assembly, having a crossbar. The step stool includes a step pivotally attached to the front rail assembly having notches which fit over the crossbar when the stool is in an open position. The step stool includes a linkage assembly pivotally and fixedly attached to the step and pivotally and fixedly attached to the crossbar. The linkage assembly compresses to allow the notches to fit over the crossbar and the linkage assembly exerting a force to maintain the crossbar in the notches when the stool is in the open position. A method for securing a step stool includes the steps of moving the notches of a step against a crossbar of a rear rail assembly pivotally connected to a front rail assembly of the step stool. There is the step of compressing a linkage assembly pivotally and fixedly attached to the step and pivotally and fixedly attached to the crossbar to allow the notches to fit over the crossbar. There is the step of exerting a force with the linkage assembly to maintain the crossbar in the notches when the stool is in the open position.

3 Claims, 24 Drawing Sheets

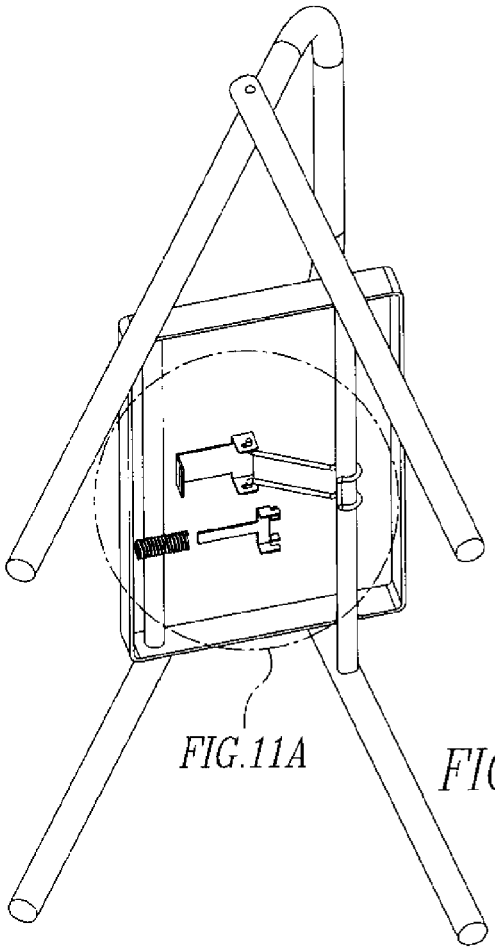
FIG.11A
FIG.11B
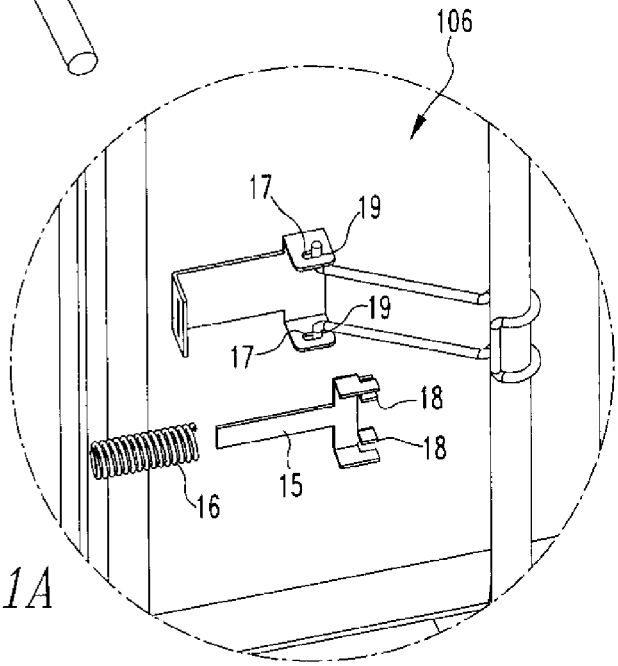
FIG.11A

STEP STOOL AND METHOD

CROSS-REFERENCE TO RELATED APPLICATIONS

This is a divisional of U.S. patent application Ser. No. 13/134,514 filed Jun. 9, 2011, now U.S. Pat. No. 8,490,748, which is a divisional of U.S. patent application Ser. No. 11/698,412 filed Jun. 21, 2011, now U.S. Pat. No. 7,963,369, both of which are incorporated by reference herein.

FIELD OF THE INVENTION

The present invention is related to securing a step stool in the fully open position with notches in a step or platform that fit over a crossbar. More specifically, the present invention is related to securing a step stool in the fully open position with slots in a step or platform that fit over a crossbar by moving the crossbar against a spring force until the crossbar can enter the notches.

BACKGROUND OF THE INVENTION

Certain ANSI specifications pertaining to folding step stools require that the step stool be equipped with some means of securing the step stool in the fully open position while it is in use. The present invention is directed to securing a folding step stool in the open position without using a separate latch component.

BRIEF SUMMARY OF THE INVENTION

The present invention pertains to a folding step stool. The step stool comprises a front rail assembly. The step stool comprises a rear rail assembly, pivotally connected to the front rail assembly, having a crossbar. The step stool comprises a step pivotally attached to the front rail assembly having notches which fit over the crossbar when the stool is in an open position. The step stool comprises a linkage assembly pivotally and fixedly attached to the step and pivotally and fixedly attached to the crossbar. The linkage assembly compresses to allow the notches to fit over the crossbar and the linkage assembly exerting a force to maintain the crossbar in the notches when the stool is in the open position.

The present invention pertains to a method for securing a step stool. The method comprises the steps of moving the notches of a step against a crossbar of a rear rail assembly pivotally connected to a front rail assembly of the step stool. There is the step of compressing a linkage assembly pivotally and fixedly attached to the step and pivotally and fixedly attached to the crossbar to allow the notches to fit over the crossbar. There is the step of exerting a force with the linkage assembly to maintain the crossbar in the notches when the stool is in the open position.

BRIEF DESCRIPTION OF THE SEVERAL VIEWS OF THE DRAWING

In the accompanying drawings, the preferred embodiment of the invention and preferred methods of practicing the invention are illustrated in which:

FIGS. 10-17 show a second embodiment of a step stool of the present invention.

DETAILED DESCRIPTION OF THE INVENTION

Figure 1:
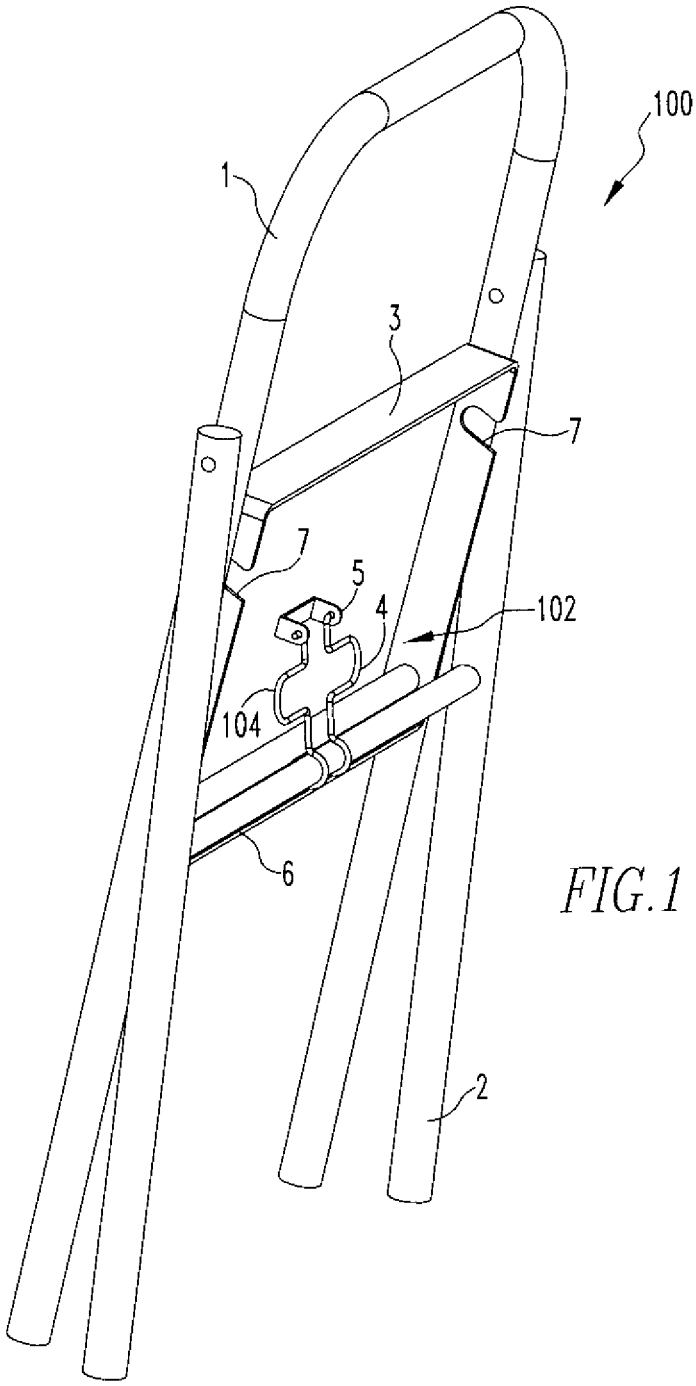
FIGS. 1-9 show a first embodiment of a step stool of the present invention.

Referring now to the drawings wherein like reference numerals refer to similar or identical parts throughout the several views, and more specifically to figure thereof, there is shown a folding step stool 100. The step stool 100 comprises a front rail assembly 1. The step stool 100 comprises a rear rail assembly 2, pivotally connected to the front rail assembly 1, having a crossbar. The step stool 100 comprises a step pivotally attached to the front rail assembly 1 having notches which fit over the crossbar when the stool is in an open position. The step stool 100 comprises a linkage assembly 102 pivotally and fixedly attached to the step and pivotally and fixedly attached to the crossbar. The linkage assembly 102 compresses to allow the notches to fit over the crossbar and the linkage assembly 102 exerting a force to maintain the crossbar in the notches when the stool is in the open position.

Preferably, the linkage assembly 102 includes a bracket fixed to the step and a link attached to the bracket. The link is preferably made of a bent metal wire. Preferably, the wire wraps about the crossbar. The link is preferably bent to form opposing loops 104. Preferably, the notches have corners which cam the crossbar and rear rail assembly 2 forward relative to the front rail assembly 1 when the corners are forced down against the crossbar.

In an alternative embodiment, the step stool 100 preferably includes a spring mechanism 106 retained by the bracket. Preferably, the spring mechanism 106 includes a spring rod and a spring disposed about the rod.

The link preferably engages the bracket. Preferably, the link is a metal wire which raps about the crossbar. The spring preferably compresses about the rod and against the bracket to allow the notches to fit over the crossbar. Preferably, the notches have corners which cam the crossbar and rear rail assembly 2 forward relative to the front rail assembly 1 when the corners are forced down against the crossbar. The spring exerts a force to maintain the crossbar in the notches when the stool is in the open position.

In an alternative embodiment, the link is preferably made of a metal wire. Preferably, the linkage assembly 102 preferably includes a bow spring retained by the bracket and connected to the link. Preferably, the bow spring compresses to allow the notches to fit over the crossbar. The notches preferably have corners which cam the crossbar and rear rail assembly 2 forward relative to the front rail assembly 1 when the corners are forced down against the crossbar. Preferably, the bow spring exerts a force to maintain the crossbar in the notches when the stool is in the open position.

In an alternative embodiment, the step is preferably a platform 27. Preferably, the platform 27 has at least one slot 34 on the side of the platform 27. The linkage assembly 102 preferably includes a link, a spring and a rivet 108, the rivet 108 extending through the slot 34 to connect the link and the spring. Preferably, the linkage assembly 102 includes a spring rod about which the spring is positioned. The platform 27 preferably includes an abutment 36 and the spring bears against the abutment 36. Preferably, the spring, rivet 108 and link are free to slide relative to the platform 27 a distance equal to the length of the slot 34. The spring preferably biases the link toward the rear end of the slot 34. The step stool 100 preferably includes an assist lever 30 attached to the platform 27 which when pushed, pushes against the crossbar causing the crossbar to move out of engagement with the notches.

The present invention pertains to a method for securing a step stool 100. The method comprises the steps of moving the notches of a step against a crossbar of a rear rail assembly 2 pivotally connected to a front rail assembly 1 of the step stool 100. There is the step of compressing a linkage assembly 102 pivotally and fixedly attached to the step and pivotally and fixedly attached to the crossbar to allow the notches to fit over the crossbar. There is the step of exerting a force with the linkage assembly 102 to maintain the crossbar in the notches when the stool is in the open position.

Preferably, the compressing step includes the step of compressing loops 104 of a bent metal wire held by a bracket of the linkage assembly 102 attached to the step. The compressing step preferably includes the step of compressing a spring about a spring rod against a bracket of the linkage assembly 102 attached to the step.

Preferably, the compressing step includes a step of compressing a bow spring against a bracket of the linkage assembly 102 attached to the step.

In the operation of the invention, several embodiments are described as follows.

First Embodiment

Figure 2:
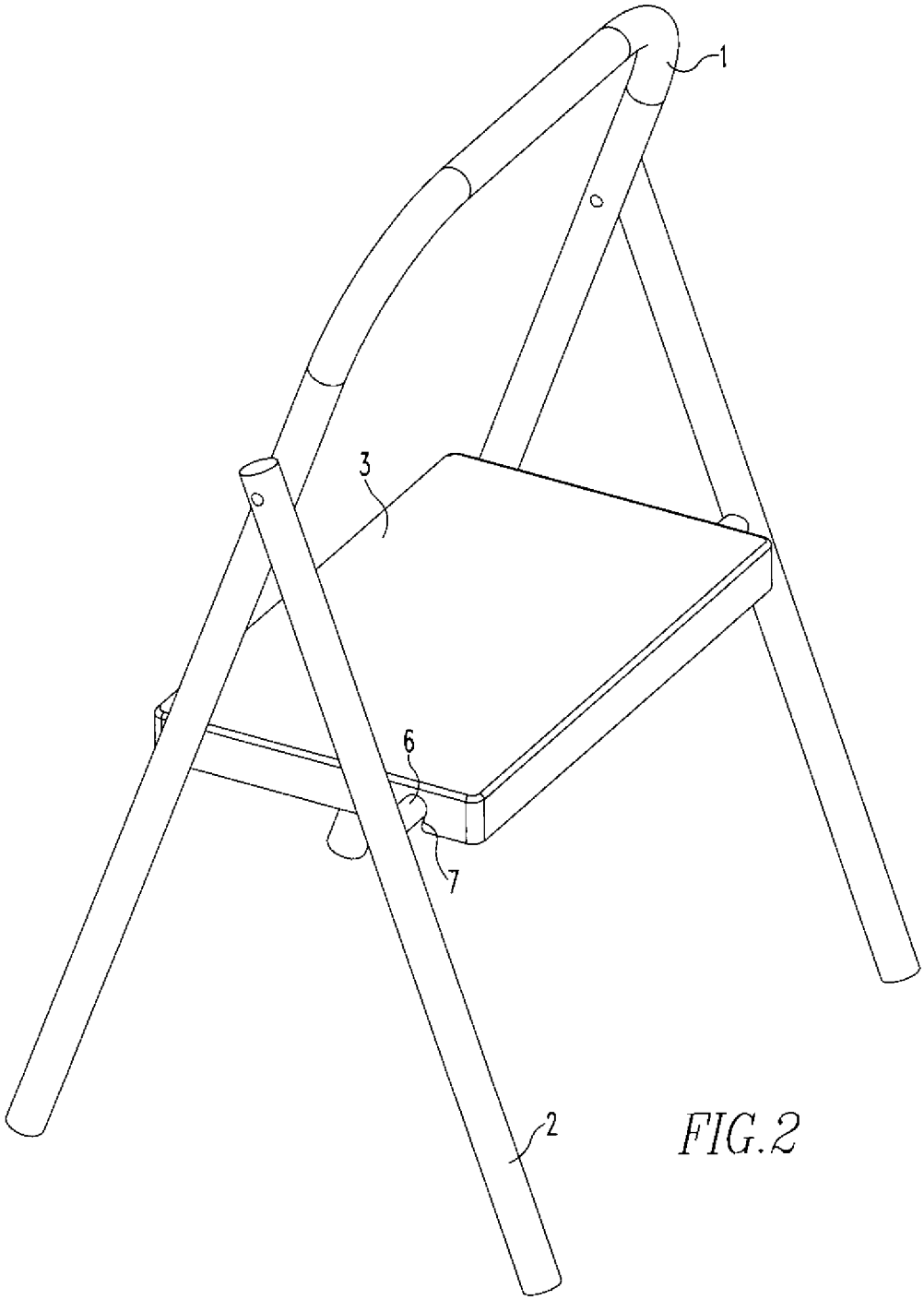
Figure 3:
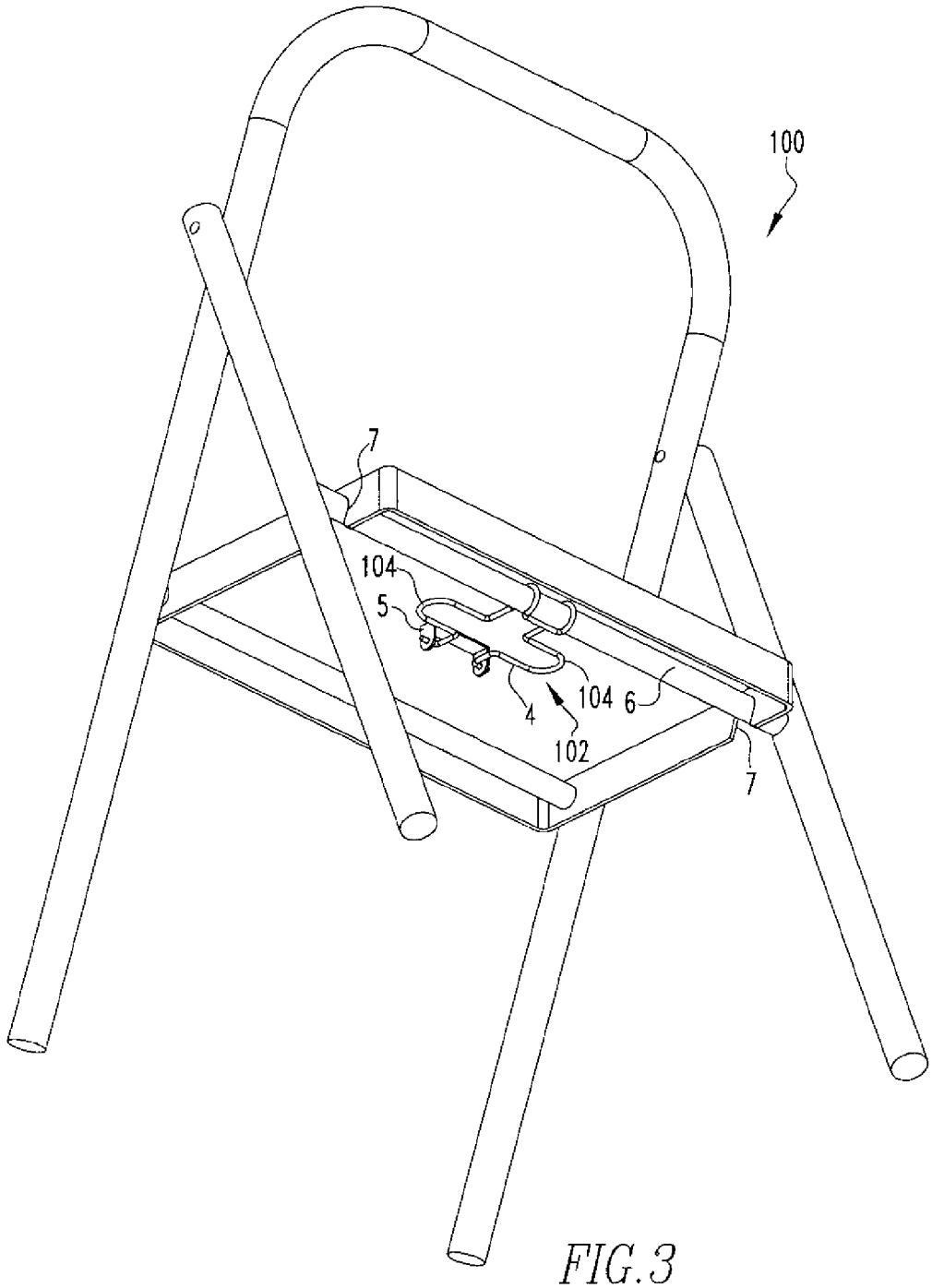

A simplified folding step stool 100 is shown closed in FIG. 1 and fully open in FIG. 2 and FIG. 3. There is a front rail assembly 1, and a rear rail assembly 2 which is pivotally connected to the front rail assembly 1. There is a step 3 and a link 4. The link is made of bent spring steel wire. One end of the link is pivotally attached to the step by a bracket 5 which is fixed to the step and the other end of the link is attached to and pivots around the crossbar 6 of the rear rail assembly 2. (This attachment can be seen more clearly in FIG. 4.) The link serves primarily to move the rear rail assembly 2 to the open position as the step is unfolded. The step has two notches 7 which fit over the crossbar when the step stool 100 is in the fully open position.

Figure 4:
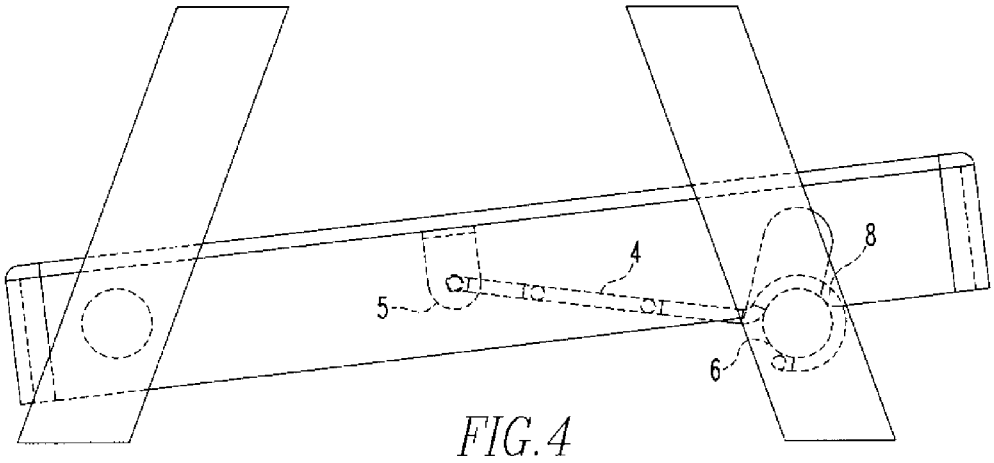

FIG. 4 is a detail side view of the step stool 100 with hidden components shown. The step stool 100 has been opened to the point where the rounded corners 8 of the notches in the step have just contacted the upper rear surface of the crossbar 6. Notice that the crossbar and rear rail assembly 2 would have to move forward slightly for the step to move to its fully open position.

Figure 5:
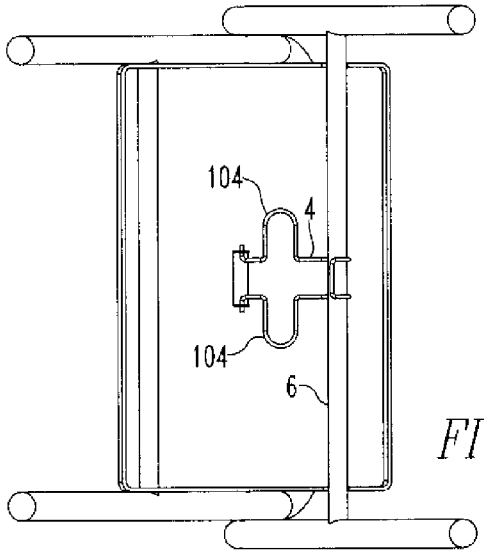

FIG. 5 is a view of the underside of the step stool 100 when it is in the position seen in FIG. 4. Notice the shape of the link 4.

Figure 6:
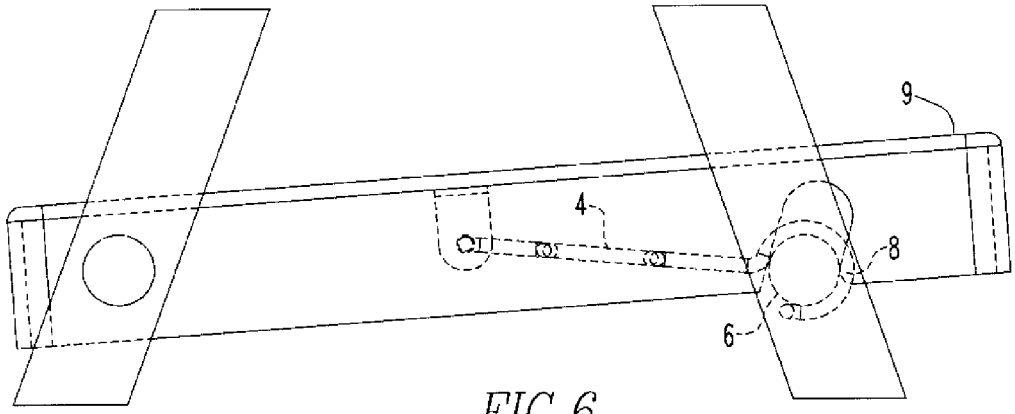
Figure 7:
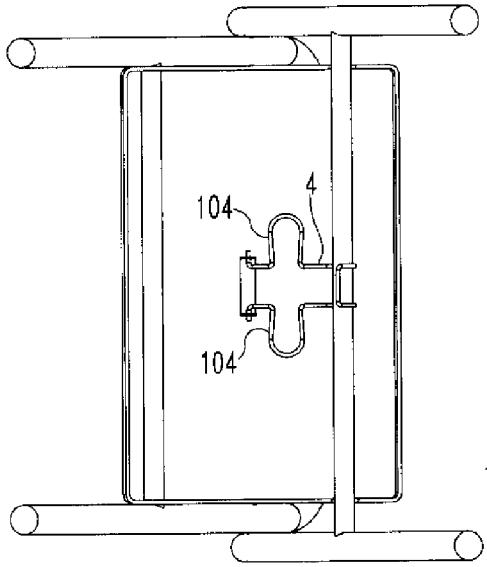

FIG. 6 shows the position of the step stool 100 after the user has pushed down on the rear of the step 9. FIG. 7 is the underside. Notice that the rounded corners of the notches 7 have cammed the crossbar 6 and rear rail assembly 2 forward a small amount, pivoting about the connection between the front and rear rail assemblies. In order for the crossbar to move forward, the link 4 has been forced to "compress" to reduce the distance between the bracket 5 and the crossbar 6 as seen when comparing FIG. 7 with FIG. 5. Note the shape of the curve 10 in both FIG. 5 and FIG. 7. It is these loops 104 of material that permit the link to compress. Being made of spring steel wire, the link exerts a force trying to push the crossbar rearward against the camming action of the rounded corners of the notches 7.

Figure 8:
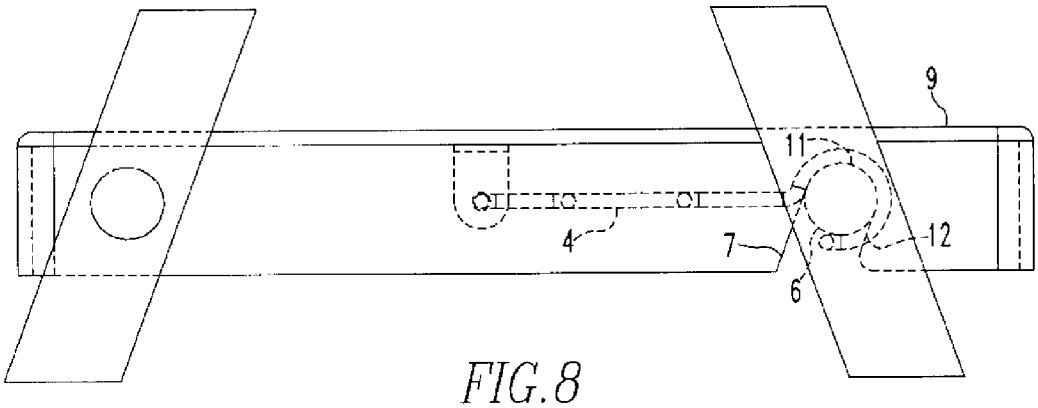
Figure 9:
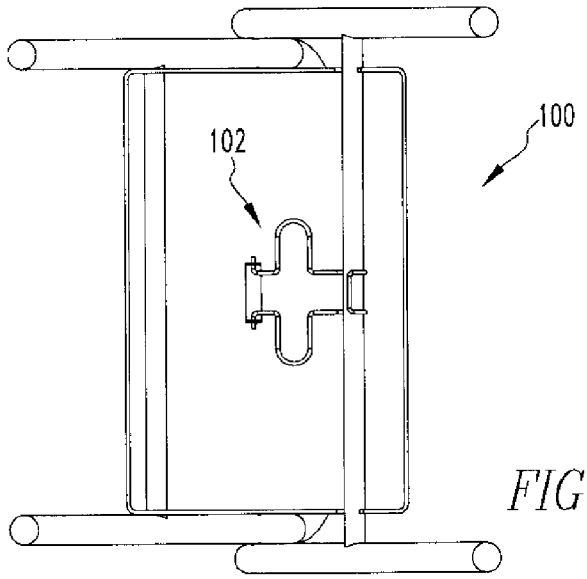

FIG. 8 and FIG. 9 show the step stool 100 after the user has pushed down on the rear 9 of the step until the crossbar 6 has moved to the upper end 11 of the notches 7. The link 4 has returned to its original shape as can be seen when comparing FIG. 9 with FIG. 7. The step of the step stool 100 is now effectively latched to the crossbar. The spring force of the link tends to keep the crossbar at the bottom of the notches 7, thus keeping the step stool 100 in the fully open position.

To return the step stool 100 to the fully closed position, the user would pull up on the rear 9 of the step (FIG. 8) with enough force to overcome the force exerted by the link 4 as it resists being compressed. After the crossbar has been cammed forward to the position seen in FIG. 6 by the slope of the notches 12, the step is free to be folded to the closed position.

Second Embodiment

Figure 10:
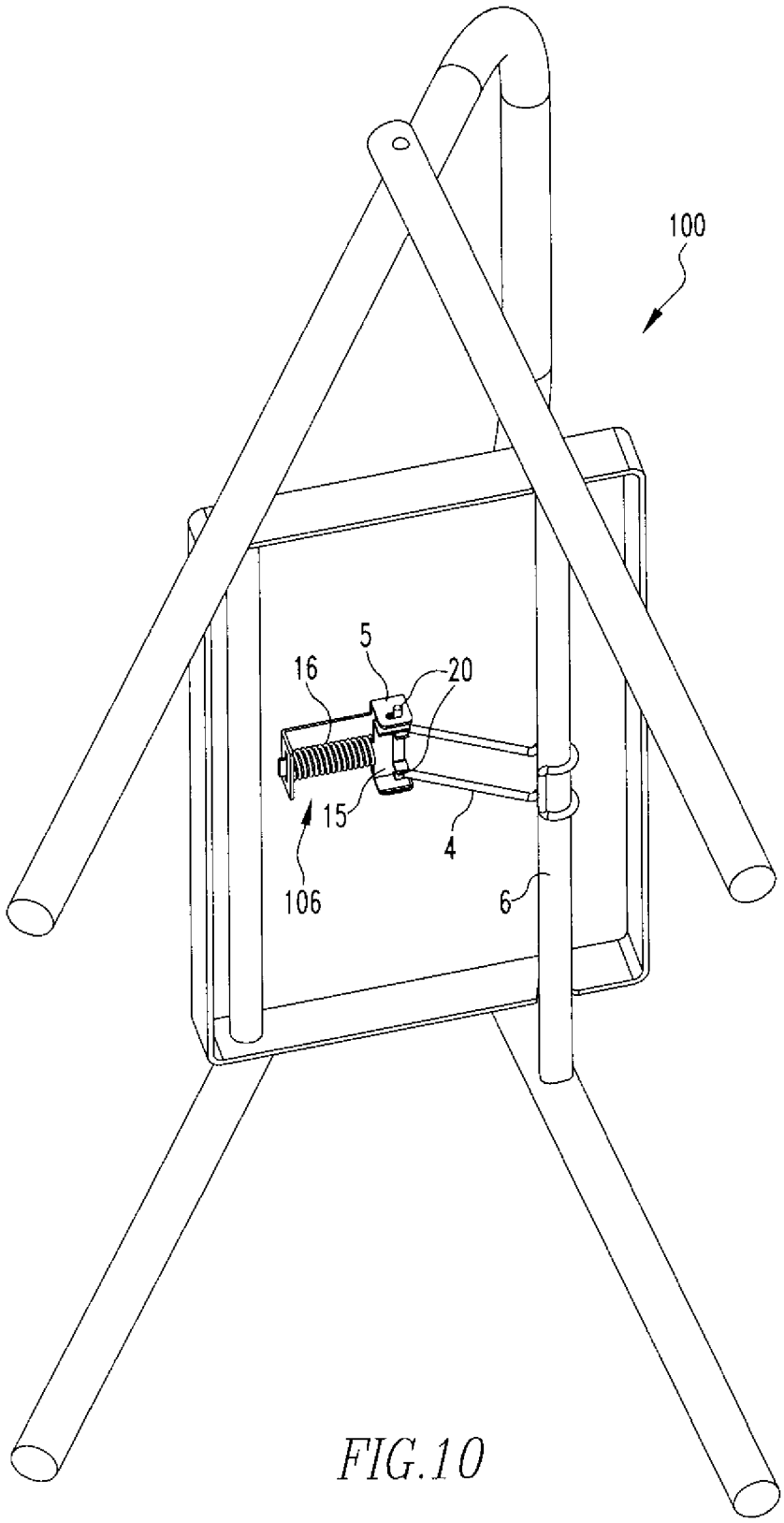

FIG. 10 shows an alternative to the design already described. In this version, the link 4 is again made of spring steel wire but is not designed to be compressible. Instead the bracket 5 is designed to retain a spring rod 15 and spring 16. These parts can be seen more clearly in the detail view of FIG. 11. The bracket 5 has slots 17 which engage the ends 20 of the link 4. One end 18 of the spring rod 15 is formed so as to engage the ends 20 of the link when it is assembled. The net effect of the spring and spring rod is to bias the ends of the link toward the rear end 19 of the slots 17.

Figure 12:
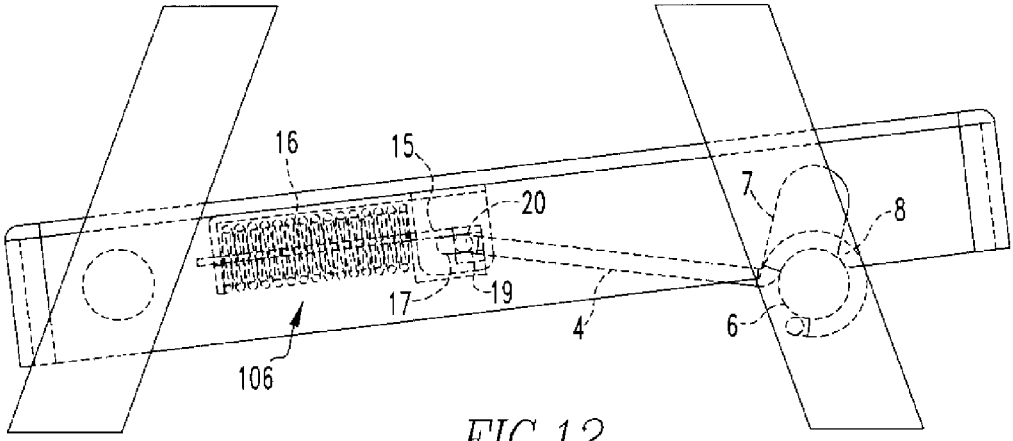
Figure 13:
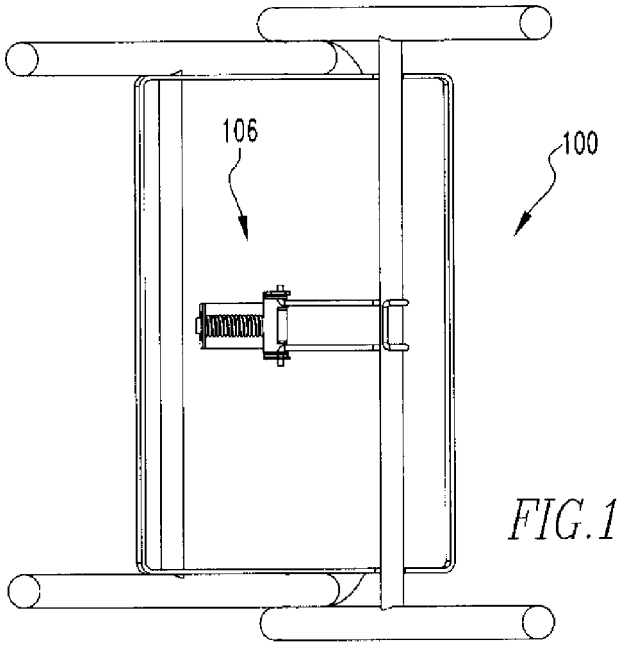

FIG. 12 shows the step stool 100 being opened and is at the point where the rounded corners 8 of the notches have contacted the upper surface of the crossbar 6. Notice that the ends 20 of the link 4 are at the rear end 19 of the slots 17 in the bracket and are held there by the force of the spring 16 acting through the spring rod 15. FIG. 13 is an underside view of the step stool 100 at this point.

Figure 14:
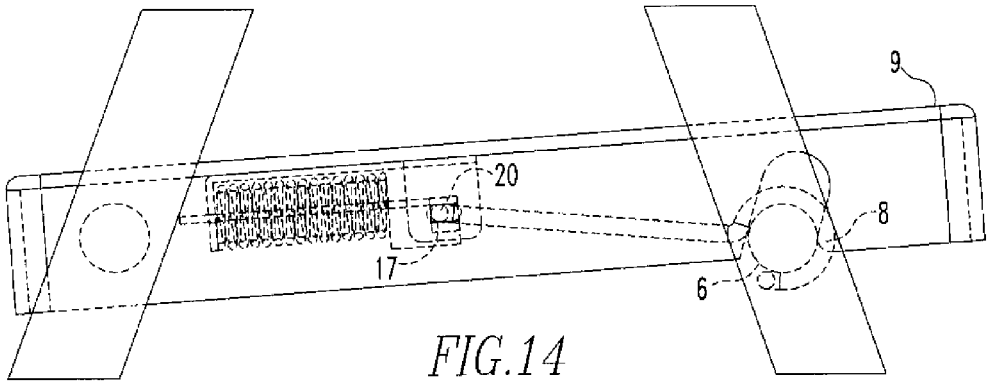
Figure 15:
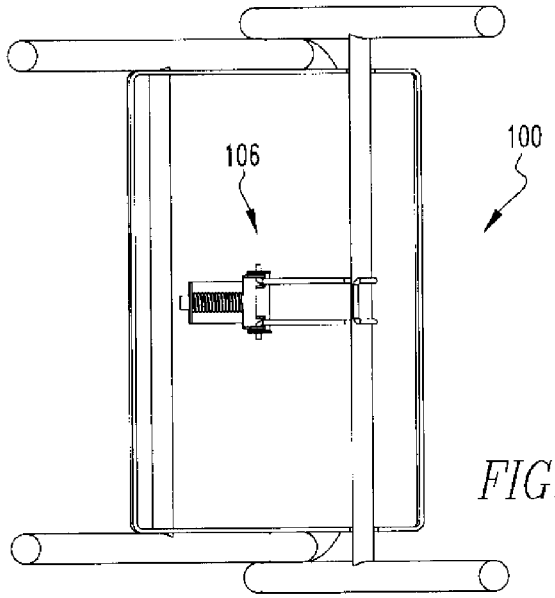

FIG. 14 shows the position of the step stool 100 after the user has pushed down on the rear 9 of the step. FIG. 15 is the underside. Notice that the rounded corners 8 of the notches 7 have cammed the crossbar 6 and rear rail assembly 2 forward a small amount, pivoting about the connection between the front and rear rail assemblies. In order for the crossbar to move forward, the ends 20 of the link 4 have moved forward in the slots 17 against the force of the spring 16.

Figure 16:
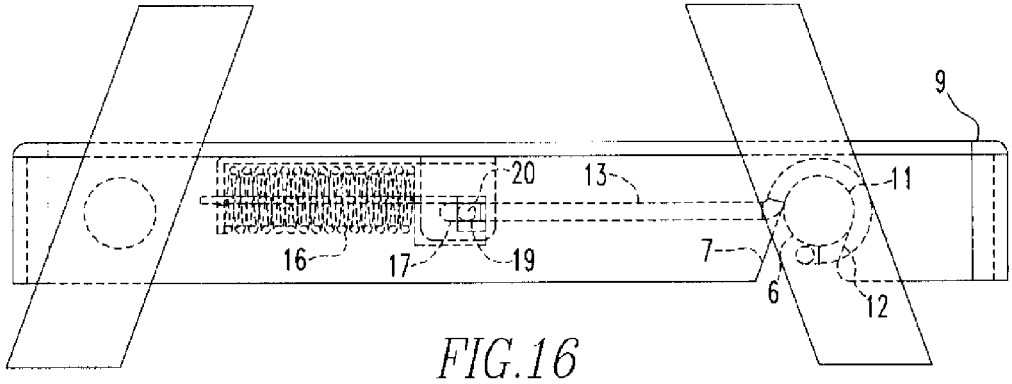
Figure 17:
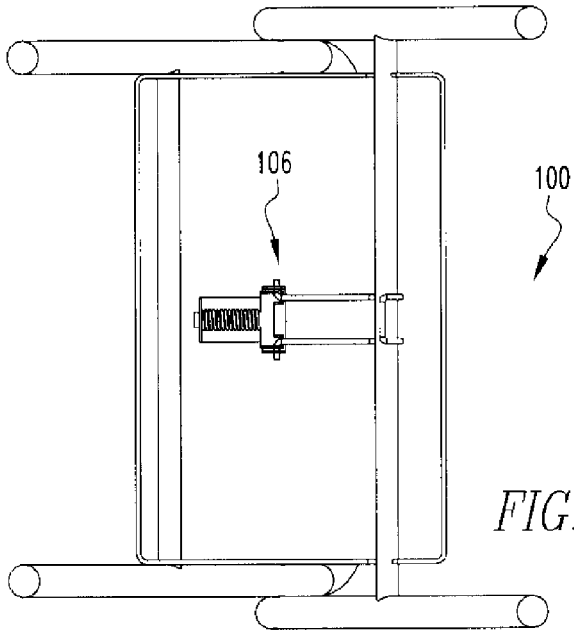

FIG. 16 and FIG. 17 show the step stool 100 after the user has pushed down on the rear 9 of the step until the crossbar 6 has moved to the upper end 11 of the notches 7. The ends 20 of the link 4 have returned to their original position at the rear end 19 of the slots 17. The step of the step stool 100 is now effectively latched to the crossbar. The force of the spring 16 acting in conjunction with the slope 12 of the notches 7 tends to keep the crossbar at the bottom 11 of the notches 7, thus keeping the step stool 100 in the fully open position.

To return the step stool 100 to the fully closed position, the user would pull up on the rear 9 of the step (FIG. 16) with enough force to overcome the force exerted by the spring 16 as it resists being compressed by the camming action of the notches 7. After the crossbar has been cammed forward to the position seen in FIG. 14 by the slope of the notches 12, the step is free to be folded to the closed position.

Third Embodiment

Figure 18:
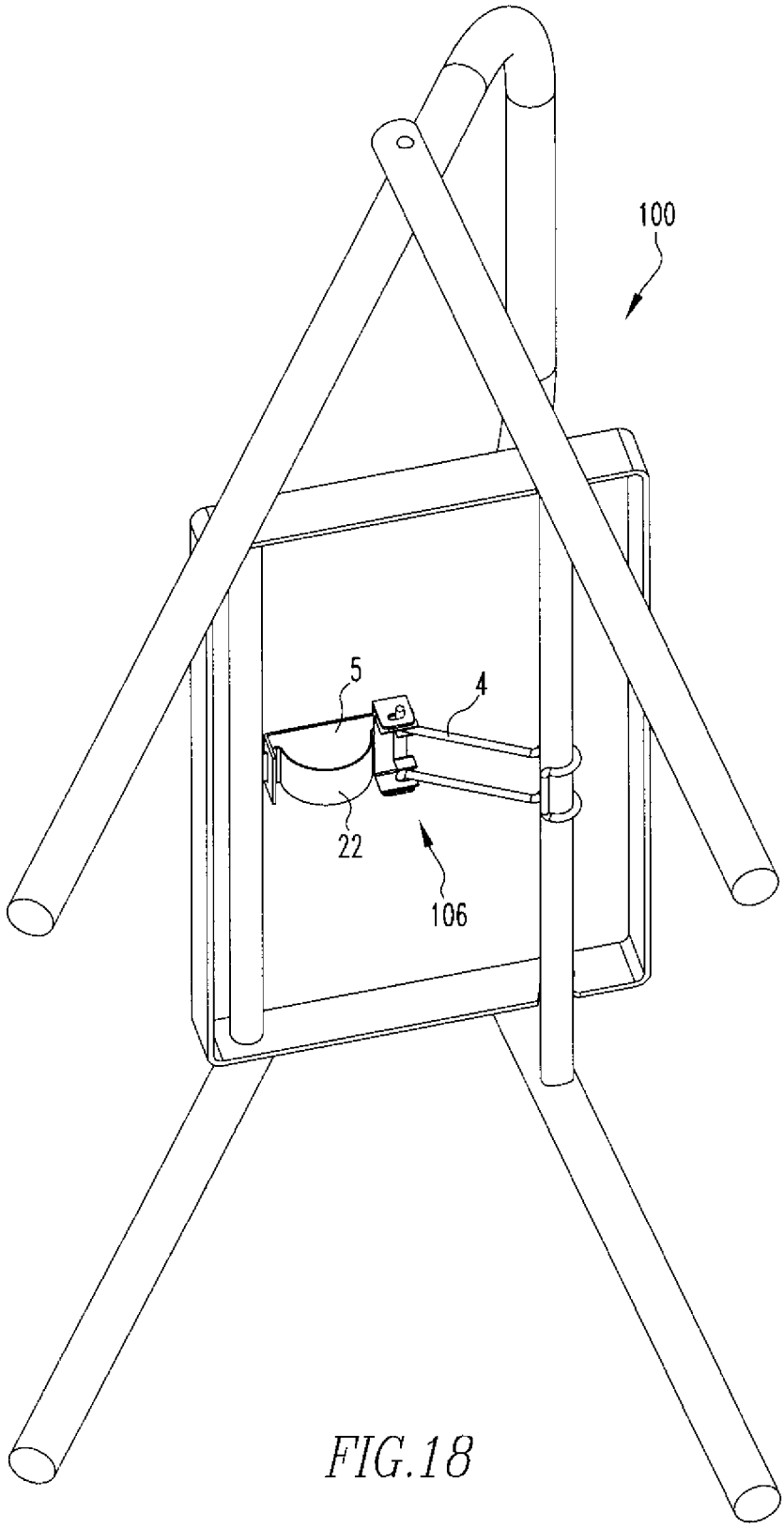
FIGS. 18-25 show a third embodiment of a step stool of the present invention.
Figure 19A:
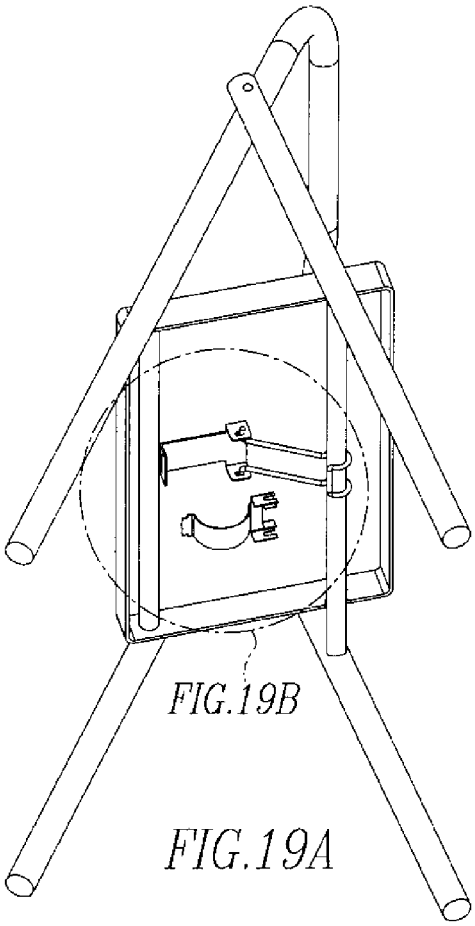
Figure 19B:
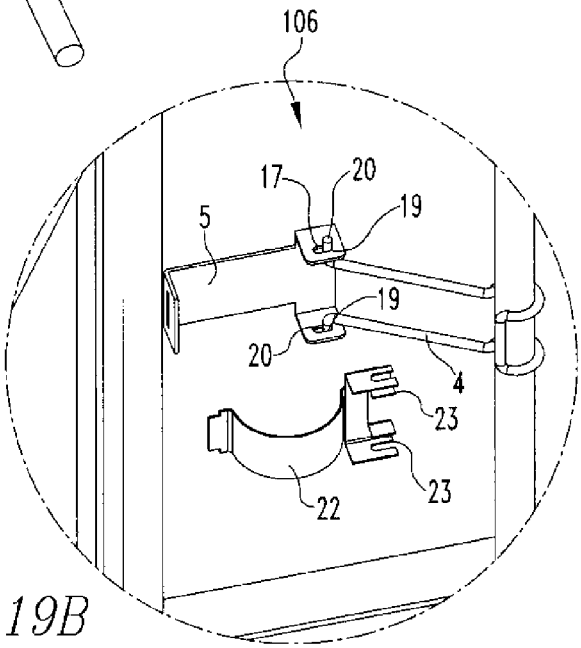

FIG. 18 shows another alternative to the design already described. In this version the link 4 is again made of spring steel wire and is not designed to be compressible. The bracket 5 is designed to retain a bow spring 22. These parts can be seen more clearly in the detail view of FIG. 19. The bow spring is made of spring steel. The bracket 5 has slots 17 which engage the ends 20 of the link 4. One end 23 of the bow spring 22 is formed so as to engage the ends 20 of the link when it is assembled. The net effect of the bow spring is to bias the ends 20 of the link 4 toward the rear ends 19 of the slots 17 in a way analogous to the second version described above.

Figure 20:
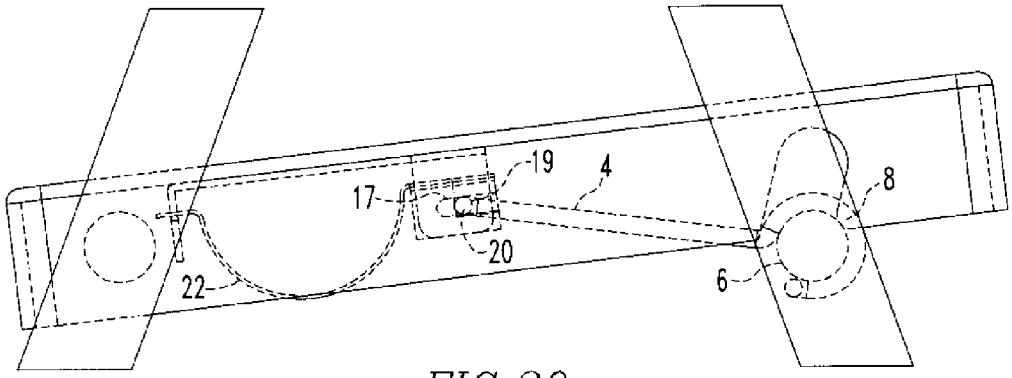
Figure 21:
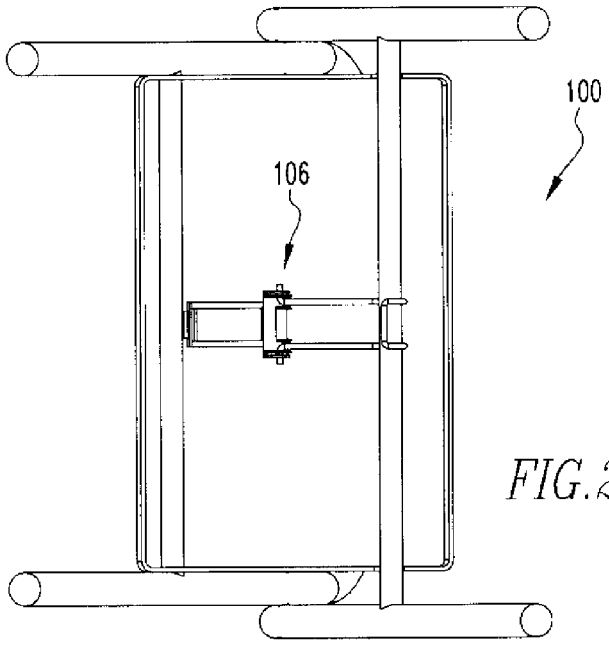

FIG. 20 shows the step stool 100 being opened and is at the point where the rounded corners 8 of the notches have contacted the upper surface of the crossbar 6. Notice that the ends 20 of the link 4 are at the rear end 19 of the slots 17 in the bracket and are held there by the force of the bow spring 22. FIG. 21 is an underside view of the step stool 100 at this point.

Figure 22:
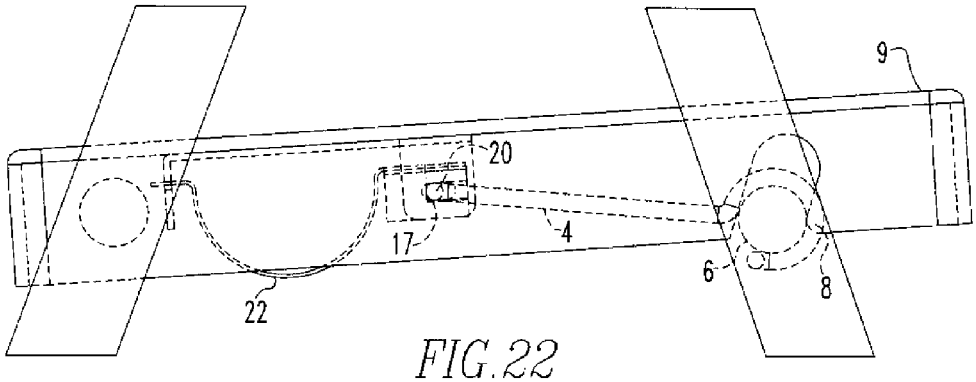
Figure 23:
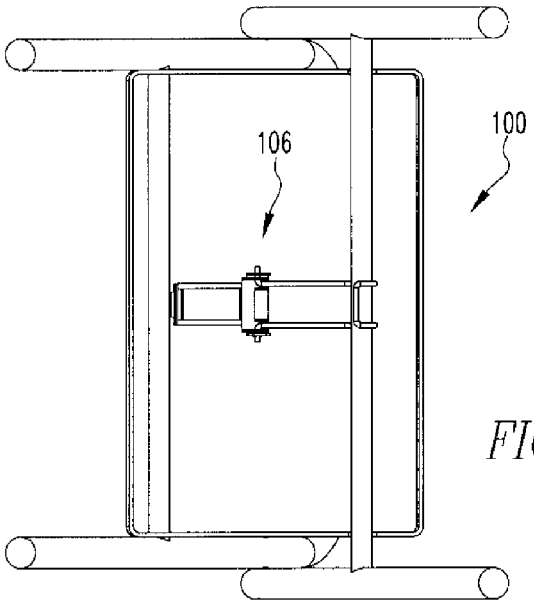

FIG. 22 shows the position of the step stool 100 after the user has pushed down on the rear 9 of the step. FIG. 23 is the underside. Notice that the rounded corners 8 of the notches 7 have cammed the crossbar 6 and rear rail assembly 2 forward a small amount, pivoting about the connection between the front and rear rail assemblies. In order for the crossbar to move forward, the ends 20 of the link 4 have moved forward in the slots 17 against the force of the bow spring 22.

Figure 24:
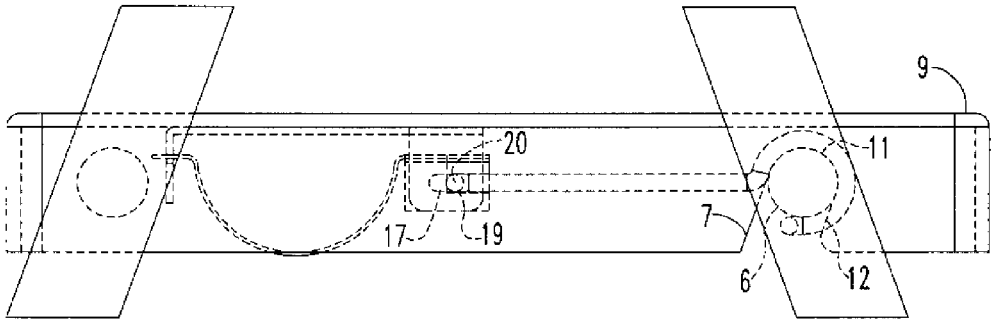
Figure 25:
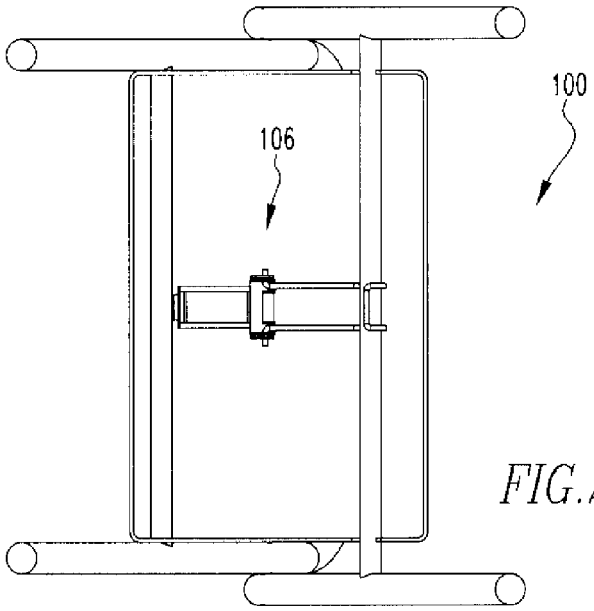

FIG. 24 and FIG. 25 show the step stool 100 after the user has pushed down on the rear 9 of the step until the crossbar 6 has moved to the upper end 11 of the notches 7. The ends 20 of the link 4 have returned to their original position at the rear end 19 of the slots 17. The step of the step stool 100 is now effectively latched to the crossbar. The force of the bow spring 22 acting in conjunction with the slope 12 of the notches 7 tends to keep the crossbar at the bottom of the notches 11, thus keeping the step stool 100 in the fully open position.

To return the step stool 100 to the fully closed position, the user would pull up on the rear 9 of the step (FIG. 24) with enough force to overcome the force exerted by the bow spring 22 as it resists being compressed by the camming action of the notches 7. After the crossbar has been cammed forward to the position seen in FIG. 22 by the slope of the notches 12, the step is free to be folded to the closed position.

Adapted to a Larger Step Stool 100

Figure 26:
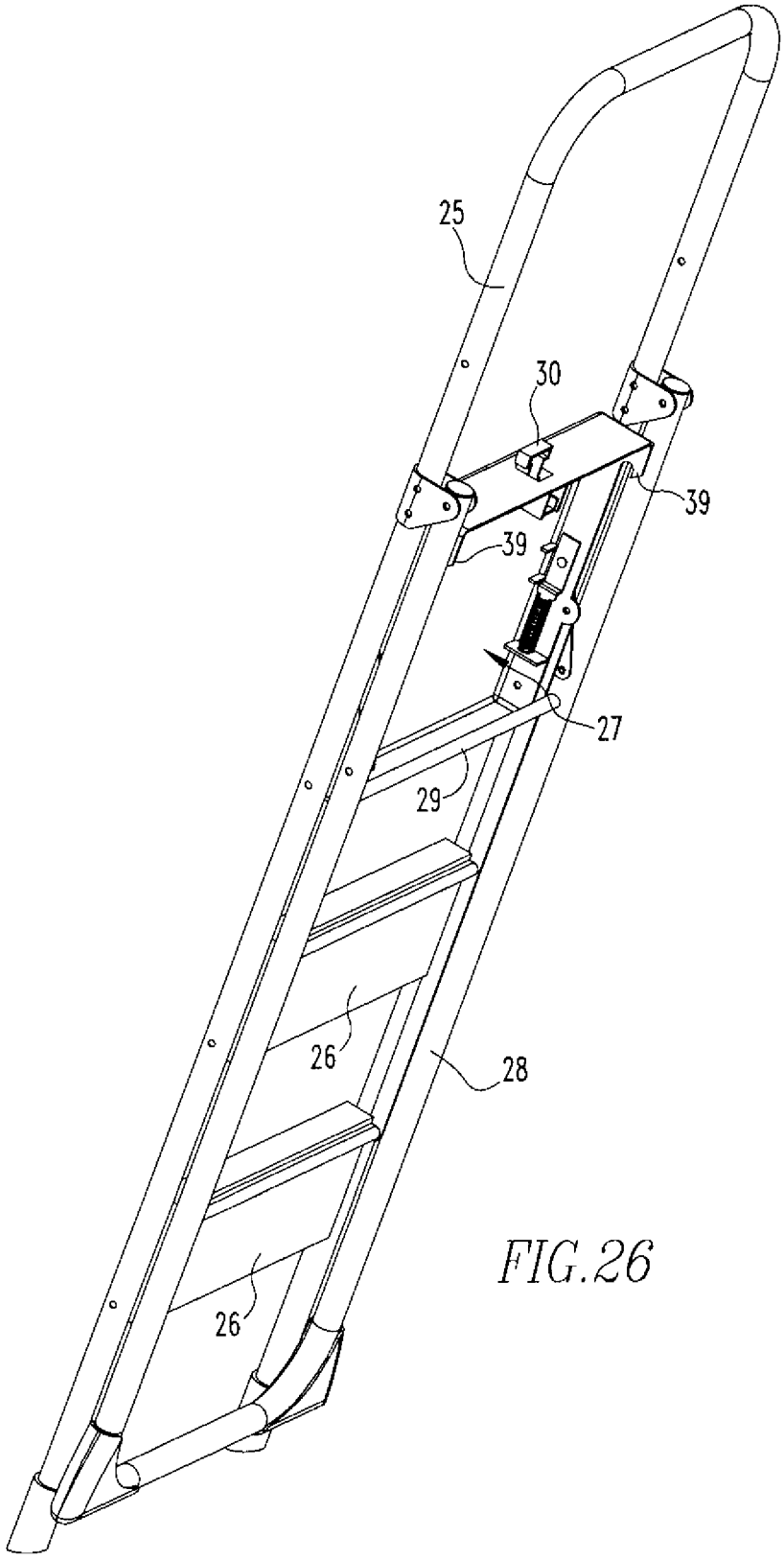
FIGS. 26-33 show a fourth embodiment of a step stool of the present invention.
Figure 27:
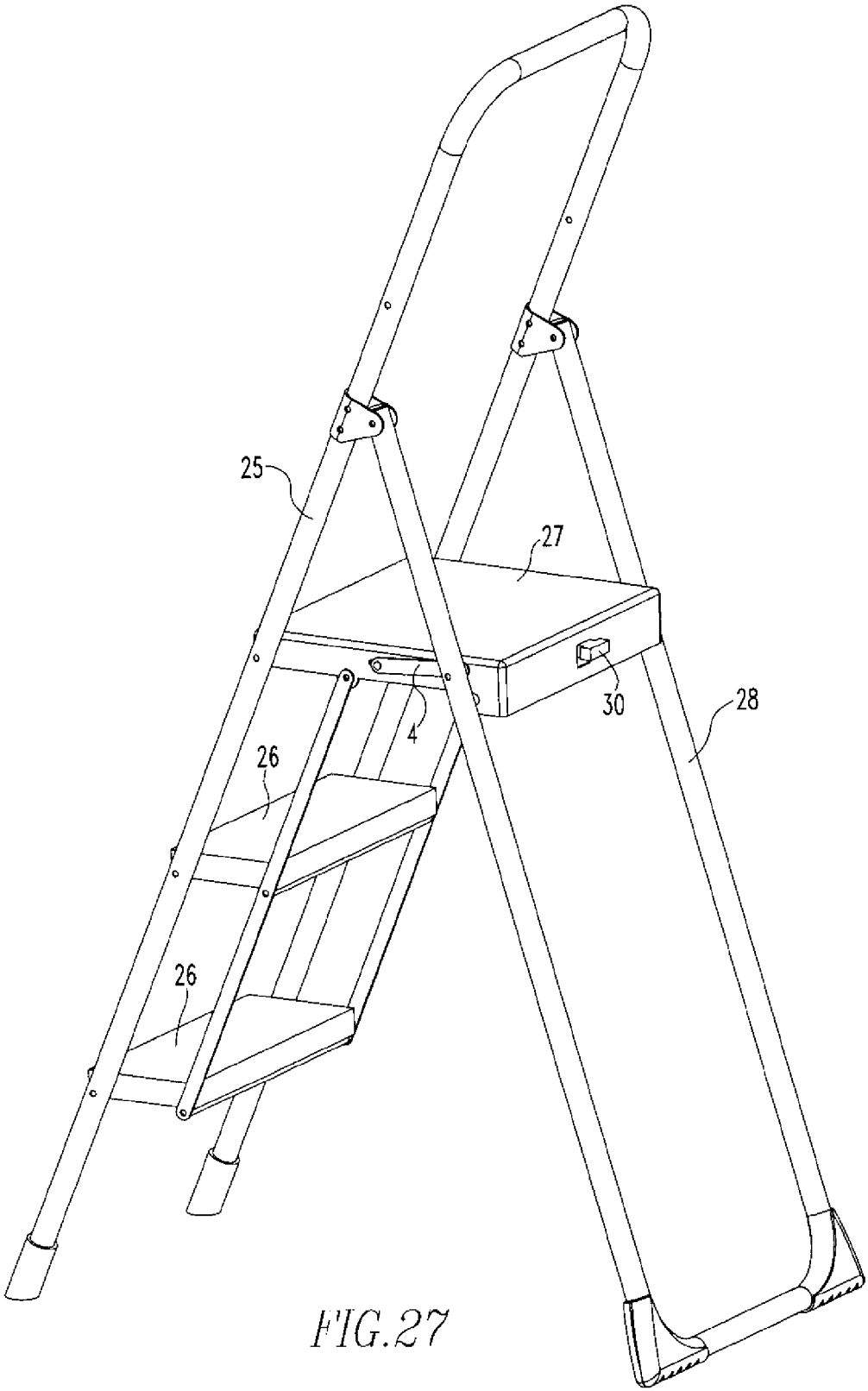
Figure 28A:
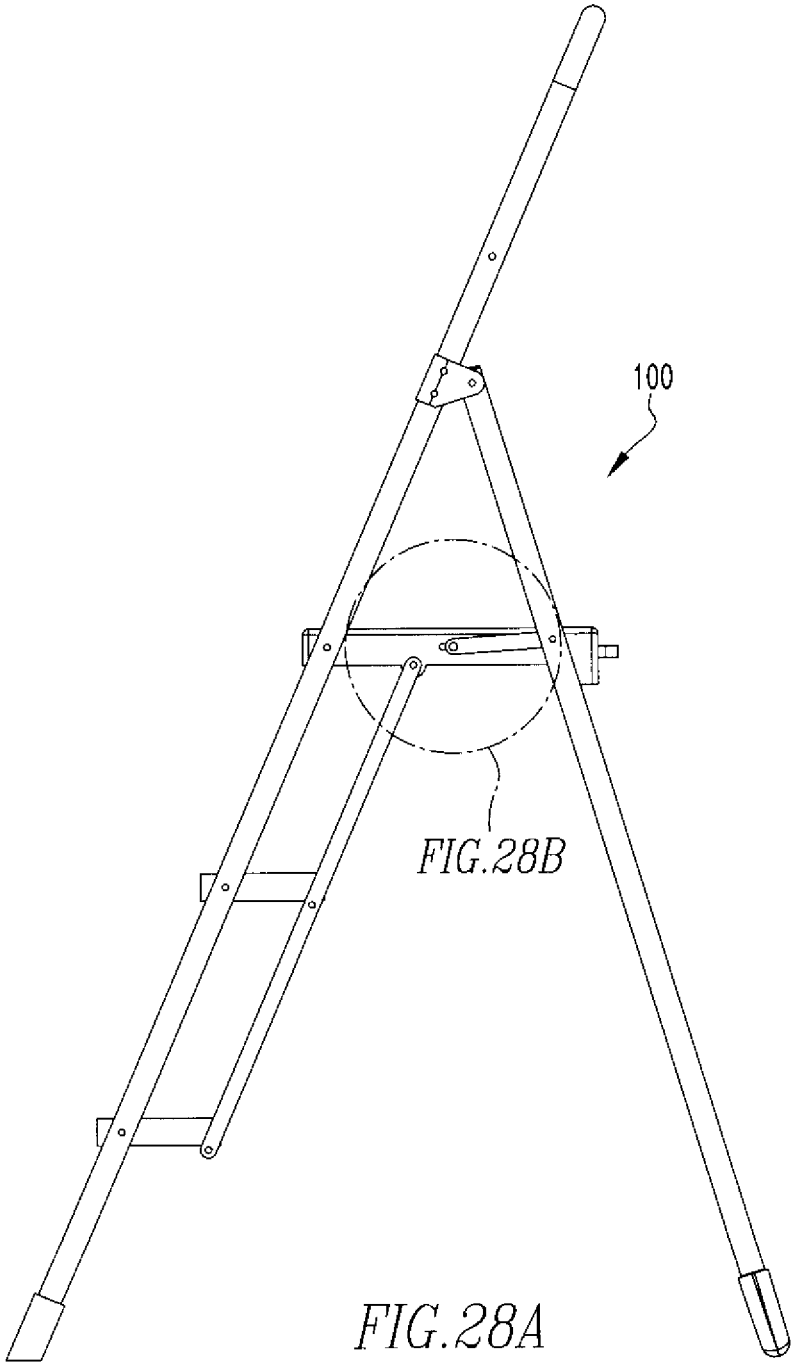
Figure 28B:
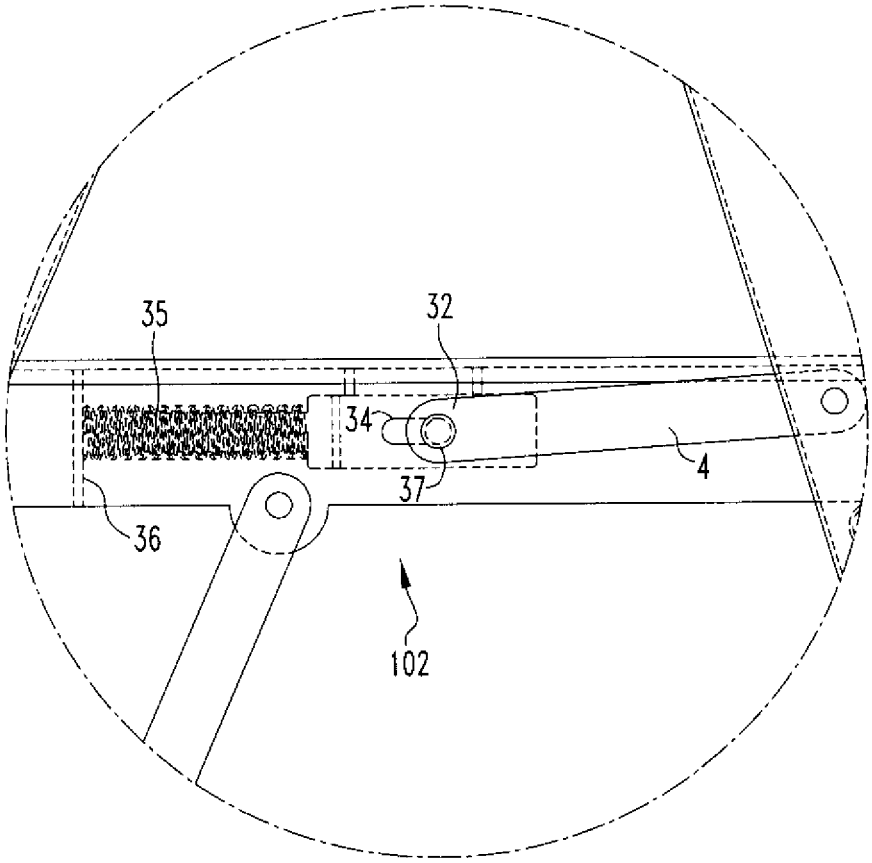

A larger step stool 100 having a platform 27 and two folding steps is shown in the closed and fully open positions in FIG. 26 and FIG. 27. Key components are the front rail assembly 25 on which pivot the steps 26 and the platform 27. Hinged to the front rail assembly 1 is the rear rail assembly 28 with its crossbar 29. The assist lever 30 is attached to the platform 27 and pivots relative to it. Two links 4 connect the platform 27 to the rear rail assembly 2 and cause the rear rail assembly 2 to move to the open position as the platform 27 is unfolded.

Additional components can be seen in FIG. 28*a*, FIG. 28*b*, FIG. 29*a* and FIG. 29*b*. One end 32 of both links 4 are riveted to spring rods 33 which are located inside the platform 27. The rivets 108 pass through slots 34 in the sides of the platform 27. The rivet 108, link, and spring rod assemblies are free to slide relative to the platform 27 a distance equal to the length of the slots 34. A spring 35 is positioned around each spring rod. The front ends of the springs bear against abutments 36 of the platform 27. The spring is partially compressed at installation. The net effect of the spring and spring rod is to bias the link end 32 toward the rear end 37 of the slot 34.

Figure 30:
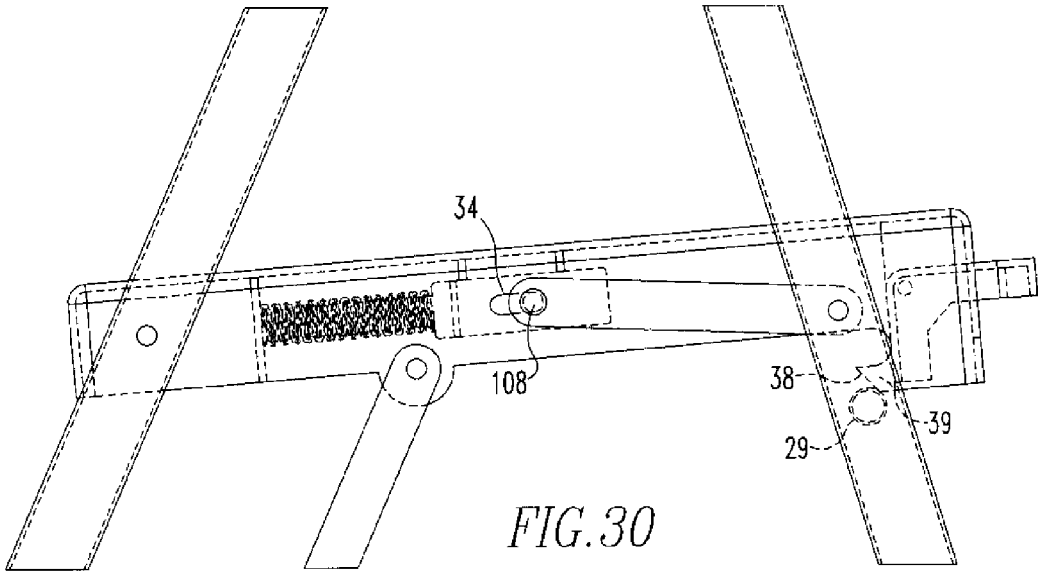
Figure 31:
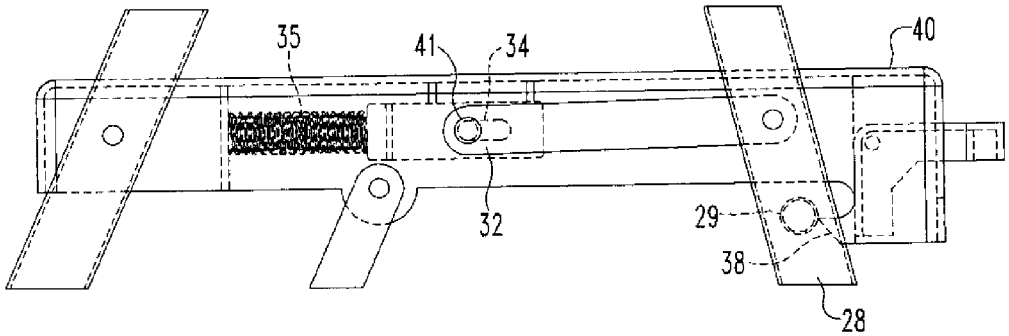
Figure 32:
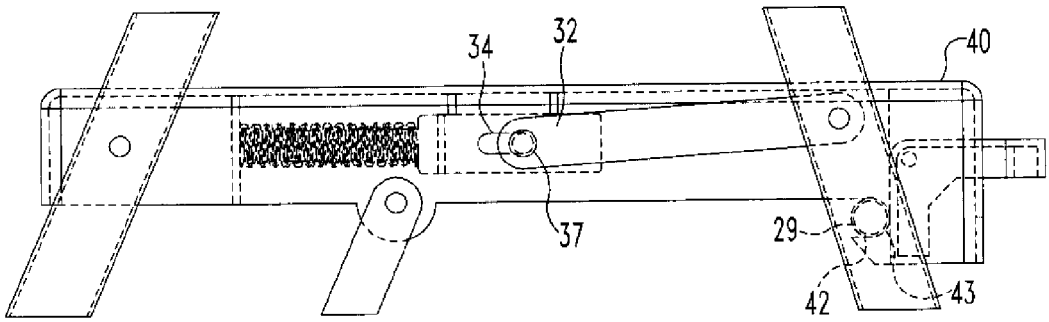

FIG. 30, FIG. 31, and FIG. 32 show the sequence of moving the step stool 100 to its fully open and latched position.

Figures 29A, 29B:
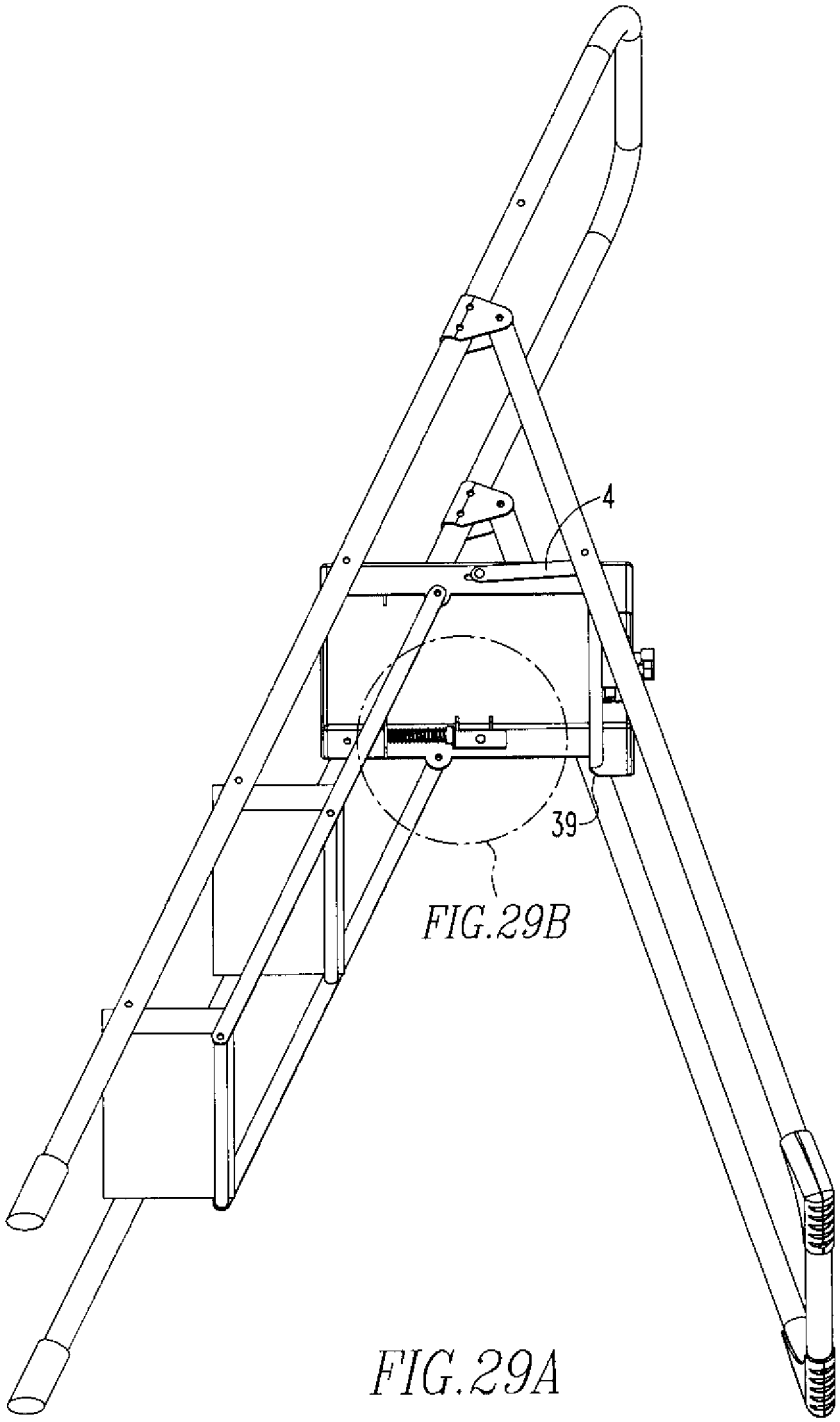
Figure 29B:
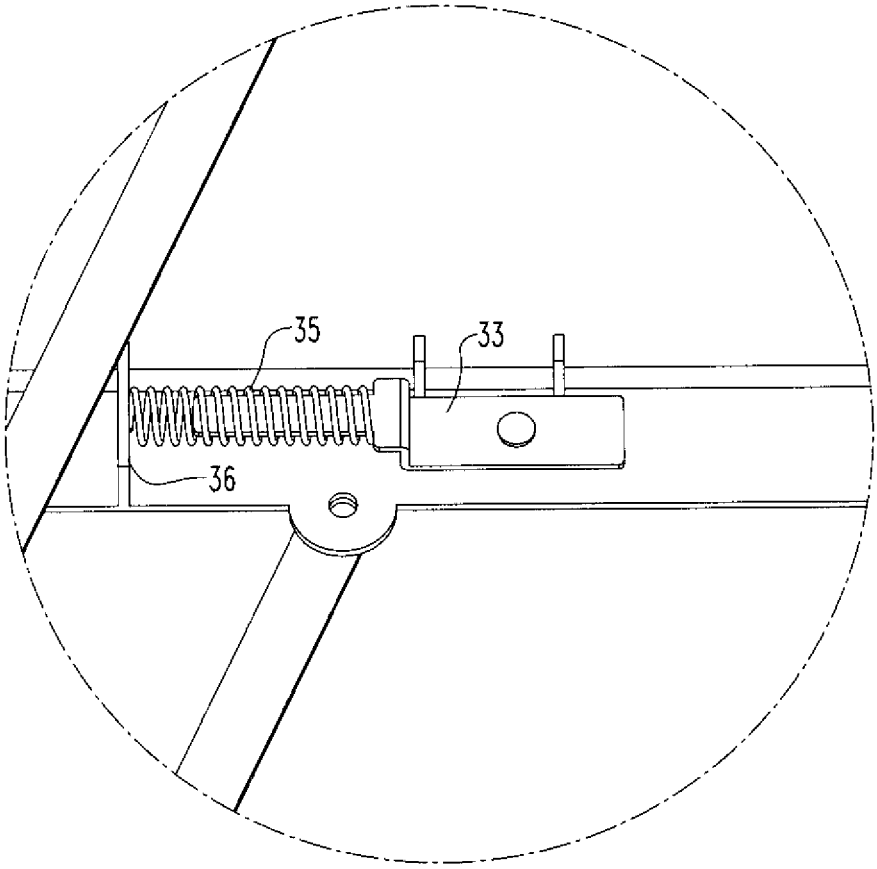

In FIG. 30, the angled faces 38 of two projections 39 on the underside of the platform 27 have just contacted the upper surface of the crossbar 29. The projections 39 may also be seen in FIG. 26 and FIG. 29.

In FIG. 31, the user has pushed down on the rear 40 of the platform 27, and the crossbar 29 and the rear rail assembly 28 have been cammed forward by the angled faces 38, pivoting about the hinges that connect the front and rear rail assemblies. For this motion to take place the end 32 of the links have been forced to the front end 41 of the slots 34, further compressing the springs 35.

FIG. 32 shows the position of the components after the user has pushed down further on the rear 40 of the platform 27. The crossbar has entered the horizontal notches 42 in the projections of the platform 27 and, under the influence of the springs, has moved to the extreme rear 43 of the notches. Notice that the ends 32 of the links have moved to the rear end 37 of the slots 34. In this position, the step stool 100 is securely latched in the open position.

Figure 33:
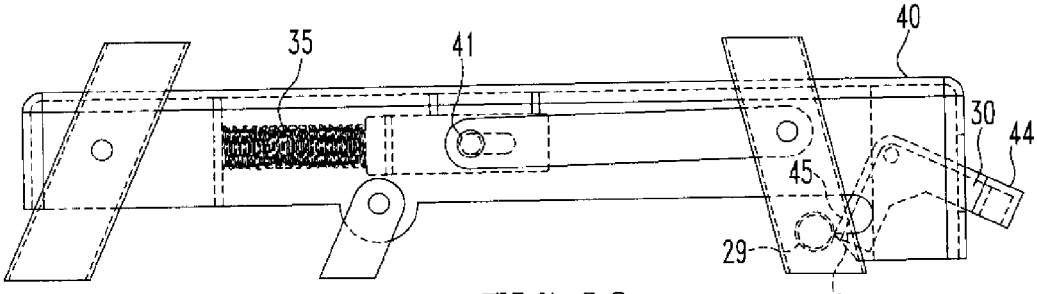

FIG. 33 shows the function of the assist lever 30 and how to close the step stool 100. Because the notches 42 are horizontal, pulling up on the rear 40 of the platform 27 will not cam the crossbar 29 out of engagement with the notches. So to close the step stool 100, the user pushes down on the tab 44 of the assist lever 30 using the thumb. The lower leg 45 of the assist lever 30 swings forward, pushing the crossbar 29 forward and out of engagement with the notches 42. At this point the user pulls up on the rear of the platform 27 to fold the platform 27 and close the step stool 100.

It should be noted that the assist lever 30 does not latch the platform 27 in the open position. In fact, if desired, the assist lever 30 could be deleted if the notches were angled to provide a camming surface rather than horizontal. Then the user could close the step stool 100 by simply pulling up on the rear of the platform 27 with sufficient force to overcome the spring force.

Each of the embodiments described above involves having the step or platform 27 notches hook onto the crossbar of the rear rail assembly. The crossbar is able to enter the notches because the crossbar and rear rail assembly 2 is able to move forward, against spring force, a short distance until it can enter the notches.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A method of securing a folding step stool comprising the steps of;

providing a step stool with a front rail assembly; a rear rail assembly, pivotally connected to the front rail assembly, having a crossbar; a step pivotally attached to the front rail assembly having notches which fit over the crossbar when the stool is in an open position;

moving the notches of the step against the crossbar of the rear rail assembly;

providing a linkage assembly pivotally and fixedly attached to the step and pivotally and fixedly attached to the crossbar; the linkage assembly includes a bracket fixed to the step and a link having a pair of ends attached to the bracket, the bracket having slots which engage the link ends, when the step is latched to the crossbar, the link ends positioned at a rear end of the slots, in order for the crossbar to move into the notches, the link ends are positioned forward in the slots; and a spring mechanism including a spring rod and a spring disposed about the rod retained by the bracket, wherein one end of the spring rod engages the ends of the link whereby the spring and spring rod bias the ends of the link toward the rear end of the slots;

compressing the linkage assembly to allow the notches to fit over the crossbar; and exerting a force with the linkage assembly to maintain the crossbar in the notches when the stool is in the open position.

2. A method as described in claim 1 wherein the compressing step includes the step of compressing the link which includes loops of a bent metal wire held by the bracket of the linkage assembly attached to the step.

3. A method as described in claim 2 wherein the compressing step includes the step of compressing the spring about the spring rod against the bracket of the linkage assembly attached to the step.

* * * * *